United States Patent [19]

Schulze-Berge

[11] 4,416,741

[45] Nov. 22, 1983

[54] METHOD AND BATH FOR THE ELECTRODEPOSITION OF PALLADIUM/NICKEL ALLOYS

[75] Inventor: Klaus Schulze-Berge, Remscheid, Fed. Rep. of Germany

[73] Assignee: Langbein-Pfanhauser Werke AG, Neuss, Fed. Rep. of Germany

[21] Appl. No.: 355,245

[22] Filed: Mar. 5, 1982

[30] Foreign Application Priority Data

Mar. 6, 1981 [DE] Fed. Rep. of Germany ..... 3108466

[51] Int. Cl.[3] ..... C25D 3/56

[52] U.S. Cl. ..... 204/43 N

[58] Field of Search ..... 204/43 N, 47, 49

[56] References Cited

U.S. PATENT DOCUMENTS

| | | | |
|---|---|---|---|
| 2,712,522 | 7/1955 | Kardos et al. | 204/49 |
| 3,254,007 | 5/1966 | Kardos | 204/49 |
| 3,378,470 | 4/1968 | Kroll | 204/49 |
| 3,502,550 | 3/1970 | Passal | 204/49 |
| 3,515,652 | 6/1970 | Law | 204/49 |
| 3,574,067 | 4/1971 | Spiro | 204/49 |
| 3,804,727 | 4/1974 | Lyde | 204/49 |

FOREIGN PATENT DOCUMENTS

| | | | |
|---|---|---|---|
| 1143178 | 2/1969 | United Kingdom | 204/43 N |

*Primary Examiner*—G. L. Kaplan
*Assistant Examiner*—Nam X. Nguyen
*Attorney, Agent, or Firm*—Karl F. Ross; Herbert Dubno

[57] ABSTRACT

In a method of electrodepositing a palladium/nickel alloy coating upon a substrate wherein said coating is plated onto said substrate by electrodeposition from a bath containing 5 to 30 g per liter of palladium and 5 to 30 g per liter of nickel and having a palladium-nickel ratio such that the coating contains 30 to 90% by weight of palladium, the improvement which comprises providing in said bath during the electrodeposition of said coating at least one acetylene alcohol or acetylene alcohol ether capable of improving the brightness and mechanical properties of said coating.

2 Claims, No Drawings

METHOD AND BATH FOR THE ELECTRODEPOSITION OF PALLADIUM/NICKEL ALLOYS

CROSS REFERENCE TO RELATED APPLICATIONS

This application is related to my copending applications Ser. No. 355,246 and Ser. No. 355,247 filed concurrently herewith.

FIELD OF THE INVENTION

My present invention relates to a method of electrodepositing or galvanically plating palladium/nickel alloys and, more particularly, to an improved bath for such galvanic deposition and to a method of forming improved coatings utilizing the new bath.

BACKGROUND OF THE INVENTION

It is known to deposit palladium/nickel alloy coatings galvanically, i.e. by electrodeposition, upon conductive substrates for decorative or technological purposes from a bath consisting essentially of an aqueous solution of palladium and nickel amines with a palladium content of about 5 to 30 g per liter, a nickel content of about 5 to 30 g per liter, and other substances such as sulfonic acids or salts thereof, the palladium/nickel ratio in this solution being established such that the galvanically deposited coating contains 30 to 90% by weight palladium.

Coatings of this type can be used as a substitute for gold platings for decorative and some anticorrosion purposes.

A conventional bath of the aforedescribed type is disclosed in British Pat. No. 1,143,178. The sulfonic acid salts are there deemed to constitute brighteners which can be added to the bath to improve the aesthetic appearance of the coating.

The salts which are employed are certain salts of naphthalene sulfonic acid and aromatic sulfonamides such as the sodium salt of naphthalene-1,5-disulfonic acid, the sodium salt of naphthalene-1,3,6-trisulfonic acid, and saccharin (o-sulfobenzoic acid imide) and para-toluenesulfonamide.

In practice, the mechanical properties of the coatings thus produced are not fully satisfactory and, indeed, the brightness may not be sufficient for many decorative purposes.

OBJECTS OF THE INVENTION

It is the principal object of the present invention to provide an improved method of the electrodepositing palladium-nickel alloy coatings whereby the disadvantages of earlier methods are obviated.

Another object of this invention is to provide an improved bath for palladium/nickel coating.

A further object of this invention is to provide a method of and a bath for the galvanic deposition of palladium/nickel coatings which have improved mechanical properties and brightness so that the use of such coatings for technological purposes as well as for decorative purposes is enlarged.

SUMMARY OF THE INVENTION

I have found, quite surprisingly, that improved mixed-crystal formation can be ensured in a palladium-nickel coating and the brightness increased while the mechanical properties of the coating are improved if there is added to the plating bath at least one and preferably a plurality of compounds selected from the group which consists of acetylene alcohols and acetylene alcohol ethers.

The addition of such compounds to the bath which contains palladium amines and a palladium content of 5 to 30 g per liter, nickel amines and the nickel content of about 5 to 30 g liter, and a palladium/nickel ratio so that the galvanically deposited coating contains 30 to 90% by weight of palladium, has been found to vastly improve the quality of the coating.

The additive preferably is added in an amount of 0.01 to 10 g per liter and consists of at least one compound and preferably a plurality of compounds having the formula $R_1{=}C{\equiv}C{-}R_2$ wherein $R_1$ is monohydroxyalkyl, dihydroxyalkyl, trihydroxyalkyl or alkyloxy, and $R_2$ is hydrogen, alkyl, monohydroxy, dihydroxy or polyhydroxyalkyl, or alkyloxy.

In the foregoing definition, the term "alkyl" is intended to mean straight or branched chain alkyl having 1–6 carbon atoms, consisting of at least one compound selected from the group which consists of:

propargylalcohol
propargyl alcoholmonoethoxylate (Hydroxyethylpropargylether)
butynediol
butynediol with 2 EO (Bis-(Hydroxyethoxy-)butyne)
butynediol with 1 PO (2-Hydroxypropylpropbutynylether)
hexyndiol
2-methylbutyne-3-ol-2
3-methylpentyne-1-ol-3
3,4-dimethylpentyne-1-ol-3
3-ethylpentyne-1-ol-3
3-isopropyl-4-methylpentyne-1-ol-3
3-methylhexyne-1-ol-3
3-propylhexyne-1-ol-3.

Mixtures of two or more of these compounds are preferable to the use of a single one of the compounds alone.

When these compounds are utilized in place of the sulfonic acid salts heretofore used, a number of surprising results are obtained:

The mixed crystal formation is constituted by fine and uniformly distributed crystallites.

The brightness is increased.

Ductility and corrosion resistance to a variety of corrosive influences are increased.

During the deposition the leveling effect is markedly improved.

Mixtures of the acetylenealcohols with sulfonic acid salts, especially those of copending application Ser. No. 355,247 can also be effectively used.

SPECIFIC DESCRIPTION AND EXAMPLES

EXAMPLE 1

Use of one acetylene alcohol

The electrolyte is constituted as follows:

20 g of palladium as $(Pd(NH_3)_4)Cl_2$
10 g of nickel as $(Ni(NH_3)_6)SO_4$
50 g of conductivity-promoting salts in the form of $(NH_4)_2SO_4$ or $NH_4Cl$
$NH_4OH$ to establishment of a pH-value of 8.5 water sufficient to bring the bath to one liter 0.01 g of butyne-2-diol-(1,4).

The bath temperature for the electrodeposition was 30° C., the substrate was moved slightly during the deposition, the cathodic current density was 1 ampere per $dm^2$ and the plating time was 10 minutes. The anode was an inert plate, e.g. stainless steel.

The substrate was a wire-brushed brass plate and the resulting coating was a bright palladium/nickel alloy layer with slight inhibition phenomenon. To test the corrosion resistance of this layer, the sheet was immersed for 60 sec in dilute nitric acid formed from equal parts of concentrated nitric acid and water. No corrosion was visible.

When the process described in British Pat. No. 1,143,178 is utilized, however, and the electrolyte instead of the aforementioned acetylene alcohol contains 10 g of sodium naphthalene-1-1,3,6-trisulfonate, the palladium/nickel layers show marked corrosion in the aforedescribed test, have less brightness and no leveling effect.

The difference in corrosive action appears to be a result of a poor mixed crystal formation in the method utilizing the aromatic sulfonic acid salts in place of the acetyleneamine. X-ray analysis shows the presence of free nickel in the coating and this is presumed to be the source of the greater corrodability.

EXAMPLE 2

Use of a combination of acetylene alcohol.

The following electrolyte is used:

20 g palladium as $(Pd(NH_3)_4)SO_4$
10 g nickel as $(Ni(NH_3)_6)Cl_2$
50 g conductivity-promoting salts such as $(NH_4)_2SO_4$ or $NH_4Cl$ to the desired conductivity
$NH_4OH$ to a pH value of 8.5
water sufficient for a one liter bath
0.1 g butyne-2-diol-(1,4)
0.03 ml propargylalcohol During galvanic deposition the bath temperature was held at 30° C. The substrate was slightly moved during the plating. THe cathodic current density was 1 ampere per $dm^2$ and the deposition time was 10 min.

The brushed brass plate serving as the substrate received a bright palladium/nickel coating with a self-leveling effect and with minor inhibition phenomena. The plating resisted the nitric acid corrosion test previously described.

EXAMPLE 3

Use of a combination of acetylene alcohols with sulfonic acid salts.

The following electrolyte is formed:

20 g palladium as $(Pd(NH_3)_4)Cl_2$
10 g nickel as $(Ni(NH_3)_6)SO_4$
50 g conductivity-promoting salts such as $(NH_4)_2SO_4$ or $NH_4Cl$ to the desired conductivity
$NH_4OH$ to a pH value of 8.5
water sufficient for a one liter bath
0.03 ml propargylalcohol
2.5 g sodiumallylsulfonate
0.01 g butyne-2-diol-(1,4)

The bath temperature during galvanic electrodeposition was 30° C., the substrate, brushed brass, was slightly moved during the deposition, the cathodic current density was one ampere per $dm^2$ and the plating time was 10 min.

The bright palladium/nickel coating showed a high degree leveling without generalized inhibition phenomena. The nitric acid test previously described in Example 1 was resisted by the product.

EXAMPLE 4

Use of one acetylene alcohol.

The following electrolyte was made:

20 g palladium as $(Pd(NH_3)_4)Cl_2$
10 g nickel as $(Ni(NH_3)_6)SO_4$
50 g conductivity-promoting salts such as $(NH_4)_2SO_4$ or $NH_4Cl$ to the desired conductivity
$NH_4OH$ to a pH value of 8.5
water sufficient for a one liter bath
0.1 ml bis-(hydroxyethoxy)-butyne (butynediol with oxyethylene [EO] groups per molecule).

The bath temperature during galvanic deposition was held at 30° C., the substrate was slightly moved during the deposition and the cathodic current density was 1 ampere per $dm^2$. The plating time was 10 min. The brushed brass plate was formed with a high brightness self leveled palladium/nickel coating with inhibition phenomena and noticeable internal stress. It resisted the nitric acid corrosion test of Example 1.

I claim:

1. In a method of electrodepositing a palladium/nickel alloy coating upon a substrate wherein said coating is plated onto said substrate by electrodeposition from a bath containing 5 to 30 g per liter of palladium and 5 to 30 g per liter of nickel and having a palladium-nickel ratio such that the coating contains 30 to 90% by weight of palladium, the improvement which comprises providing in said bath during the electrodeposition of said coating at least one acetylene alcohol or acetylene alcohol ether capable of improving the brightness and mechanical properties of said coating by promoting mixed crystal deposition, said acetylene alcohol or acetylene alcohol ether being selected from the group which consists of:

propargylalcohol
propargylalcoholmonoethoxylate (Hydroxyethylpropargylether)
butynediol
butynediol with 2 EO (Bis-(Hydroxyethoxy)-butyne)
butynediol with 1 PO (2-Hydroxypropylpropbutynylether)
hexynediol
2-methylbutyne-3-ol-2
3-methylpentyne-1-ol-3
3,4-dimethylpentyne-1-ol-3
3-ethylpentyne-1-ol-3
3-isopropyl-4-methylpentyne-1-ol-3
3-methylhexyne-1-ol-3 and
3-propylhexyne-1-ol-3.

2. A bath for the electrodeposition of palladium/nickel alloy coatings upon a substrate, said bath comprising an aqueous solution:

a palladium amine in an amount sufficient to provide a palladium content in said bath of 5 to 30 g per liter, nickel amine in an amount sufficient to provide a nickel content in said bath of 5 to 30 g per liter, the palladium-nickel ratio being sufficient to deposit a coating of 30 to 90% by weight palladium, and at least one acetylene alcohol or acetylene alcohol ester compound in an amount of 0.01 g per liter to 10 g per liter and sufficient to improve the brightness of said coating by promoting mixed crystal deposition, said acetylene alcohol or acetylene alcohol ether being selected from the group which consists of:

propargylalcohol
propargylalcoholmonoethoxylate (Hydroxyethylpropargylether)
butynediol
butynediol with 2 EO (Bis[Hydroxyethoxy]-butyne)
butynediol with 1 PO (2-Hydroxypropylprobutynylether)
hexynediol
2-methylbutyne-3-ol-2
3-methylpentyne-1-ol-3
3,4-dimethylpentyne-1-ol-3
3-ethylpentyne-1-ol-3
3-isopropyl-4-methylpentyne-1-ol-3
3-methylhexyne-1-ol-3 and
3-propylhexyne-1-ol-3.

* * * * *